United States Patent [19]

Vits

[11] 4,429,602

[45] Feb. 7, 1984

[54] METHOD OF CROSSCUTTING A WEB AND STACKING THE CUT SHEETS, AND IMPACT-TYPE CROSSCUTTER FOR WEBS WITH SHEET STACKER

[75] Inventor: Hilmar Vits, Leichlingen, Fed. Rep. of Germany

[73] Assignee: Vits-Maschinenbau GmbH, Langenfeld, Fed. Rep. of Germany

[21] Appl. No.: 295,278

[22] Filed: Aug. 24, 1981

[30] Foreign Application Priority Data

Sep. 4, 1980 [DE] Fed. Rep. of Germany ..... 3033245
May 29, 1981 [DE] Fed. Rep. of Germany ..... 3121414

[51] Int. Cl.[3] ..... B26D 7/00; B65H 35/04

[52] U.S. Cl. ..... 83/24; 83/26; 83/88; 83/96; 83/110; 83/236; 83/261; 83/262

[58] Field of Search ..... 83/88, 110, 156, 236, 83/261, 262, 98, 99, 402, 23, 29, 96, 24, 26

[56] References Cited

U.S. PATENT DOCUMENTS

| | | | |
|---|---|---|---|
| 2,182,871 | 12/1939 | Jones et al. | 83/262 |
| 2,769,495 | 11/1956 | Pomper et al. | 83/96 |
| 3,029,775 | 4/1962 | Nicholson | 83/236 X |
| 3,248,983 | 5/1966 | Denny et al. | 83/236 X |
| 3,272,651 | 9/1966 | Quirk | 83/110 X |

*Primary Examiner*—James M. Meister

*Attorney, Agent, or Firm*—Sprung, Horn, Kramer & Woods

[57] ABSTRACT

There is disclosed a method of crosscutting a web and stacking the resultant sheets which comprises continuously feeding said web toward a cutter, decelerating the feed of said web at the cutting point for the duration of the cutting operation, while continuing the feed toward said cutter at the same rate whereby a back-up occurs in the feed direction, cutting said web, causing the new head end of the web so formed upon said cutting to overlap the tail end of the resultant cut sheet on the conveying path, conveying said sheet to a sheet stack, after said cut sheet is moved onward to said sheet stack at normal conveying speed increasing the conveying speed of the web toward said cutter until the web portion which has backed up ahead of the cutting point has been stretched taut and caused to overlap the tail end of the cut sheet. Also disclosed is an apparatus for performing such process comprising a conveying unit upstream of a cutter having at least two conveying units and a conveying unit downstream of the cutter. The two units of the upstream conveyor are operable at different speeds whereby back-up occurs at one stage of the cutting operation while the web is fed continuously at constant speed. Acceleration of one of the units of the upstream conveyor causes the web to be once again stretched taut for cutting whereby the web can overlap a newly cut sheet.

21 Claims, 4 Drawing Figures

METHOD OF CROSSCUTTING A WEB AND STACKING THE CUT SHEETS, AND IMPACT-TYPE CROSSCUTTER FOR WEBS WITH SHEET STACKER

BACKGROUND OF THE INVENTION

1. Field of the Invention

The invention relates to a method of crosscutting a web and stacking the cut sheets on a sheet stack, wherein the web being continuously fed to the crosscutter is decelerated, in particular to a standstill, at the cutting point for the duration of the cutting operation and after the cut the new head end of the web is caused to overlap the tail end of the cut sheet on the conveying path to the sheet stack.

The invention further relates to an impact-type crosscutter for webs comprising conveying means preceding and following the impact cutter, which after the cut cause the new head end of the web to overlap the tail end of the cut sheet and transport the latter to a sheet stack.

2. Discussion of Prior Art

Impact-type crosscutters have the advantage over rotary crosscutters that they are able to stack the sheets directly downstream of the impact cutter, that is to say, the sheet, which is immobilized during the cut, need not again be accelerated.

This, however, poses difficulties whith large-size sheets, and especially with those used in the electrical-insulation industry. Since the sheet must be slid across the stack, the resulting friction produces an electrostatic charge, so that even with a blown-in air cushion and the stack positioned obliquely, the sheet to be deposited is pulled along the upper sheets of the stack. As a result, as the height of the stack increases, the sheet slides less and less readily. Especially in the case of long sheets, this may make it impossible to deposit the sheet by sliding it forward on the stack. The electrostatic charge then is so great that it cancels out the lubricating effect of the air cushion, and sliding the sheet forward to lay it down or to straighten it for formation of a straight-edged stack then is difficult or impossible.

Difficulties of this type are not encountered with rotary crosscutters, where the sheet is moved to the stack by means of floating bars. However, rotary crosscutters entail much greater complexity of construction for overlapping the sheets and for decelerating them to a speed permitting satisfactory stacking of the sheets. In addition, rotary crosscutters are not suited for cutting all materials. Some materials are so brittle that they can be cut without fraying at the cut edge only with impact cutters.

SUMMARY OF THE INVENTION

It is an object of the invention, therefore, to provide a method of crosscutting webs and stacking the cut sheets which, without entailing great mechanical complexity, assures trouble-free stacking of even long sheets.

This object is accomplished by a process wherein after the cut, the cut sheet is transported to the stack at normal conveying speed and the new head end of the web is moved at increased conveying speed until the web portion which backed up ahead of the cutting point during deceleration has been stretched taut, and according to the process is caused to overlap the tail end of the cut sheet.

This invention further contemplates an apparatus for cutting a web into sheets and stacking the resulting sheets comprising an impact cutter, a first web conveying means upstream of said impact cutter and a second conveying means downstream of said cutter, said first conveying means comprising at least two units forming a backing-up section therebetween, a first of these units provided with means to engage a web without slippage whereby to establish the basic feed rate of said web through said crosscutter, a second unit provided with means to release said second unit from engagement with said web in synchronism with activation of said impact cutter, said second unit comprising means to convey said web at a rate greater than the rate at which it is conveyed by said first unit, said second unit provided with means to convey said web with slippage relative to said web, said first unit of said first conveying means provided with means to convey said web at a rate substantially equal to the rate said second conveying means conveys the web.

To provide assurance that, after the cut, the sheet is not conveyed at an undefined speed even for a short time but is conveyed only at the basic web speed, the distance between the impact cutter and the conveying means which is disposed directly ahead of the sheet stack and operates slippage relative to the web when the latter is taut is, in accordance with the invention, kept at less than a sheet length.

The mechanical requirements for the withdrawal of sheet samples of a length much smaller than the conventional sheet length can be readily satisfied by providing the conveying means downstream of the impact cutter with a driven conveying roll whose conveying speed can be varied, and in particular reduced to zero. Provision is preferably made for the conveying roll to be uncoupled from the drive and for a brake acting on the conveying roll to be actuated. By reducing the conveying speed of the conveying means, in particular to zero, the sheet which is subject to the action of the conveying means is markedly decelerated. Thus, when a short sheet is cut from the web, it can be withdrawn from the conveying path. The advancing web will again perfectly overlap the trailing end of the cut sheet, due to the reduction of its conveying speed between the second unit of the first conveying means and the impact cutter. Acceleration of this feed rate following a cutting, whereby the web is stretched taut, disposes the advancing end of the web over the newly formed sheet.

It has been found advantageous to provide between the second unit of the conveying means ahead of the impact cutter and the impact cutter a hold-down means for the web that is actuated in synchronism with the actuation of the impact cutter. The function of this hold-down means is to stop the web so that it is at a standstill at the instant the cut is performed. When such a hold-down means is employed and the length of the sheet to be cut is greater than the distance between the hold-down means and the conveying means ahead of the stack, it is essential to maintenance of the effectiveness of the hold-down means that the conveying means ahead of the sheet stack be set so that it operates with slippage when the web is held back by the hold-down means.

For actuation of the impact cutter, and optionally of the hold-down means, and for disengagement of the second unit of the conveying means ahead of the impact cutter, a common drive can be provided to which the impact cutter, the hold-down means and said second unit can be connected through a clutch. The common drive for impact cutter and hold-down means is then synchronized with the conveying speed of the conveying means ahead of the impact cutter. The clutch is preferably a single-revolution clutch.

This coordinated actuation of the various elements in synchronism with the conveying speed provides assurance that the crosscutter works satisfactorily at both high and low conveying speeds. The backing up of the web ahead of the cutter and the degree of overlapping are independent of conveying speed.

In place of a single-revolution clutch and of the derivation of the drive from the main drive, a common drive utilizing a rotary-piston engine for reversible rotation may be employed for actuation of the impact cutter, and optionally of the hold-down means, and for disengaging the second unit of the conveying means ahead of the impact cutter. Such a rotary-piston engine, which rotates the drive 360 degrees clockwise or counterclockwise, operates independently of the conveying speed. This poses a problem in overlapping. To overcome the attendant difficulties and secure adequate overlapping, the driven and brakeable conveying roll can be actuated jointly with the rotary-piston engine. By decelerating the conveying roll, and with it the sheet just cut, more or less markedly, adequate overlapping is secured even with high conveying speeds.

In accordance with a further characteristic of the invention, the actuating means for the impact cutter, the hold-down means and the second unit of the conveying means are formed by connecting rods driven by a crankshaft as drive.

BRIEF DESCRIPTION OF THE DRAWINGS

The invention will now be described in greater detail with reference to the accompanying drawing illustrating an embodiment in a diagrammatic side-elevational view wherein.

DETAILED DESCRIPTION OF THE INVENTION

Figure 1:
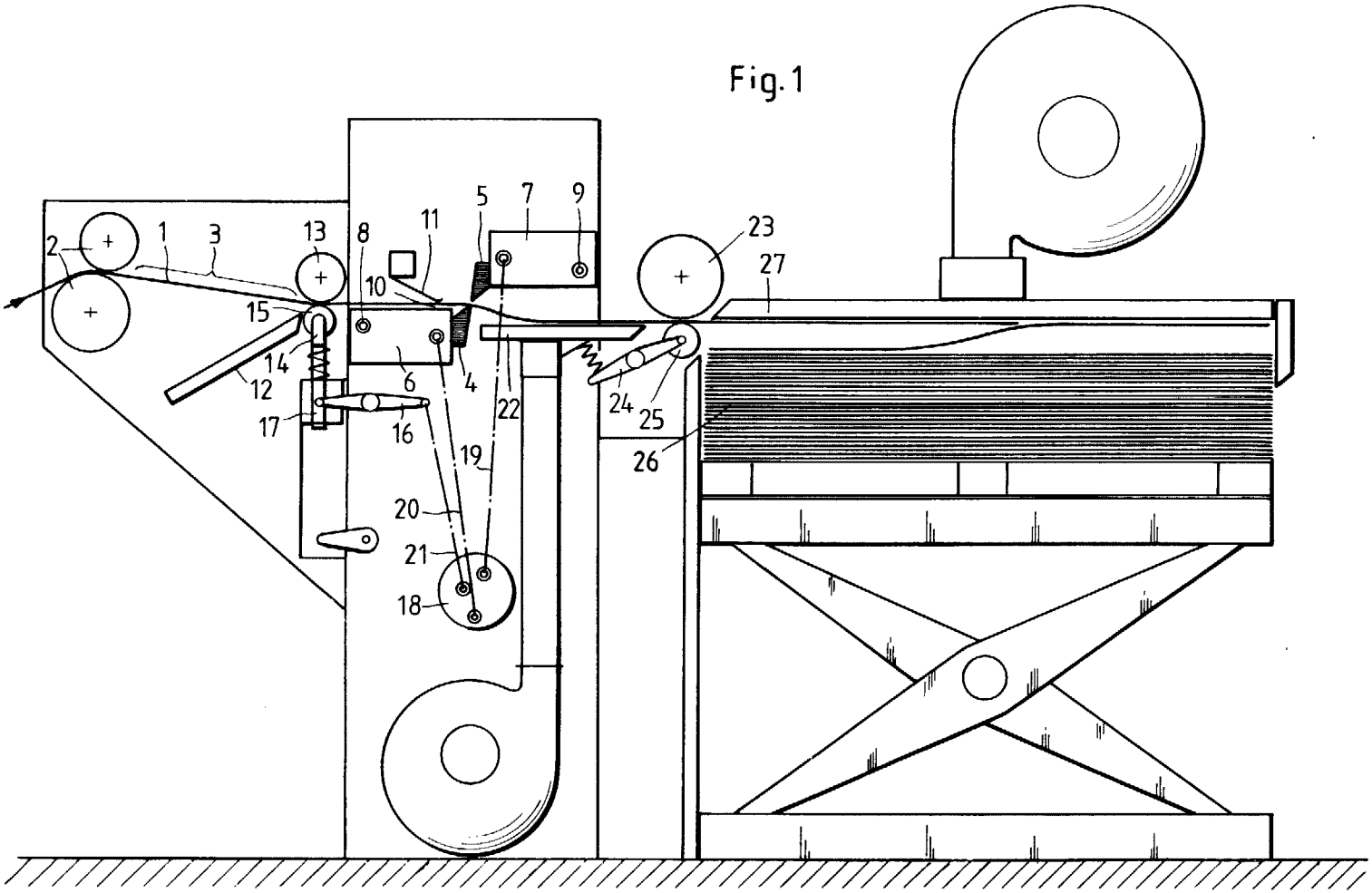
FIG. 1 shows an impact-type crosscutter with a sheet stack immediately prior to the cut.

From a roll (not shown) a web 1 is drawn through a first unit, formed by a pair of rolls 2, of a conveying means and fed over a backing-up section 3 to an impact cutter formed by a lower blade 4 and an upper blade 5. The impact cutter blades 4 and 5 are carried by pivot bars 6 and 7, respectively, which pivot on bearings 8 and 9. The top of the pivot bar 6 forms a table which cooperates with a hold-down 11 made of spring sheet and disposed above the web 1.

In the backing-up section 3, directly downstream of the pair of rolls 2, a floating-bar group 12 supplied with blowing air is disposed. In operation, the floating-bar group 12 is flipped down, as shown in the drawing. In that position it supports with aerodynamic forces the web 1 which backs up for the duration of the cut. For introduction of a new web, the floating-bar gorup 12 is slipped up.

Downstream of the floating-bar group 12 there is disposed a second unit of the conveying means which consists of an upper, driven roll 13 and a lower roll 15 which rotates freely in spring-mounted forks 14. The latter are slidably mounted in a bracket 16 that is held by a linkage 17. For actuation of the pair of impact-cutter blades 4 and 5 and for bringing the roll 15 into engagement, a crankshaft 18 is provided to which the pivot bars 6 and 7 and the bracket 16 are linked through connecting rods 19, 20 and 21. The points at which the connecting rods 19 to 21 are linked to the crankshaft 18 are such that, with the hold-down means 10 and 11 engaged, the web 1 is not pressed against the driven roll 13 by the roll 15 during the cut, as is apparent from the drawing.

The crankshaft 18 can be connected, through a single-revolution clutch (not shown but known per se) to the main drive, likewise not shown, for the driven rolls 2 and 13. It is a characteristic of such single-revolution clutches that when engaged they connect the element to be driven, in this case the crankshaft 18, to the drive for a full revolution. (Pamphlet of the Danfoss company entitled "Schritt-Aktivatoren für Stufenregelung" [Step activators for step-by-step regulation], 1980.)

From the impact cutter 4 and 5, the web 1, or rather the cut sheets, pass over a short conveying path comprising floating bars 22 disposed below the conveying plane and supplied with blowing air, and, downstream thereof, a conveying means formed by an upper, driven roll 23 and lower roll 25 which rotates freely in sprong-mounted fork 24, and to a stack 26 of sheets. Floating bars 27 supplied with blowing air are disposed above the stack 26. Like the other conveying means, the roll 23 is driven by the main drive, at the same or a slightly higher conveying speed.

The impact-type crosscutter described operates as follows:

The web 1 is fed by the pair of rolls 2 to the open impact cutter 4 and 5 at the conveying speed v. During this transport, the conveying roll 13 is also in action, since with the crankshaft 18 (FIG. 1) at a standstill the rolls 15 press the web 1 against the conveying roll 13. However, the pressure exerted by the rolls 15 due to the spring-mounted forks 14 is so low that with a taut web 1 there is slippage between the roll 13, which rotates at increased speed (for example, $1.3 \times v$), and the web 1. The web 1 is further acted upon by the conveying roll 23, which rotates at very slightly increased speed ($1.01 \times v$). However, since the spring-mounted rolls 25 exert but low pressure, there is some slight slippage here. The conveying speed of the web 1 thus is controlled solely by the conveying speed of the pair of rolls 2.

With the crankshaft 18 in the position shown in FIG. 1, the hold-down means 10 and 11 are not engaged. The web 1 therefore is conveyed freely, its transport being promoted by the floating bars 22 and the conveying roll 23.

Figure 2:
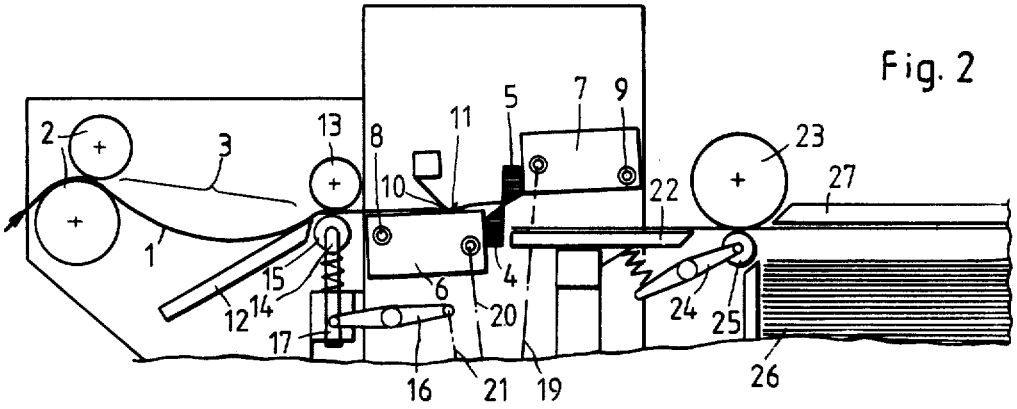
FIG. 2 shows a portion of the impact-type crosscutter of FIG. 1 during the cut.

To cut off a sheet, the single-revolution clutch is engaged. The crankshaft 18 is thus coupled to the drive and entrained for one revolution. As the crankshaft 18 revolves, the pivot bar 6 is swung upwardly, with the web 1 then being jammed between the table 1o and the hold-down 11 (FIG. 2). As a result, the web 1 comes to a standstill. At the same time, the rolls 15 are lowered, and the conveying roll 13 therefore is no longer able to exert any conveying action on the web 1. The latter than backs up between the hold-down means 10 and 11 and the conveying rolls 2, which continue in operation. The portion of the web located downstream of the hold-down means 10 and 11, which is already subject to the action of the conveying roll 23, is likewise held back since because of the low pressure exerted by the rolls 25 the conveying roll 23 operates with slippage relative to the hold-down 11. Only after the cut has been made is the conveying roll 23 able to move the cut sheet onward at very slightly increased speed (for example, $1.01 \times v$).

Figure 3:
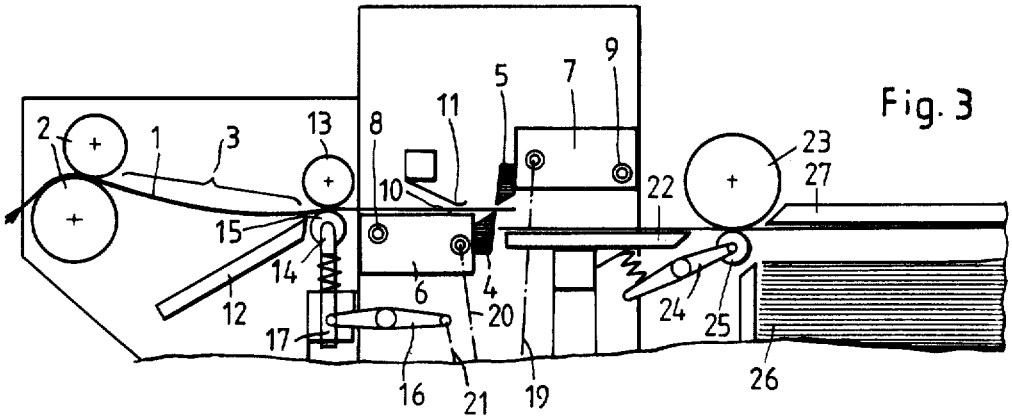
FIG. 3 shows a portion of the impact-type crosscutter of FIG. 1 immediately after the cut.
Figure 4:
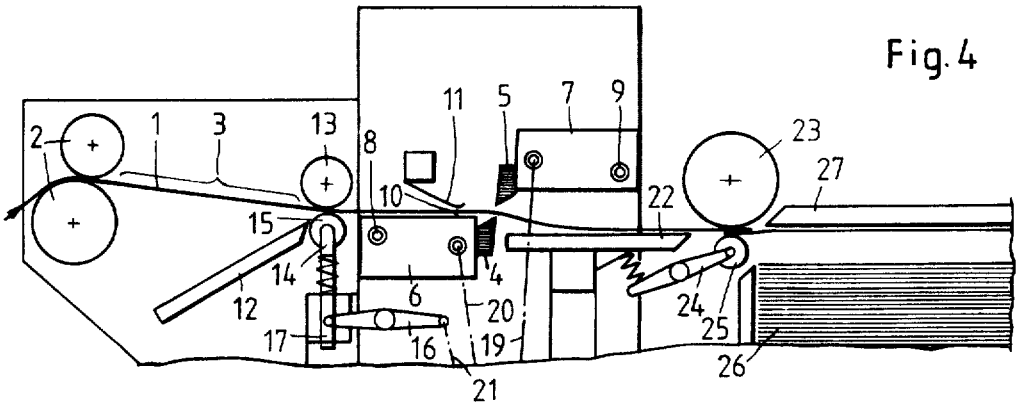
FIG. 4 shows a portion of the impact-type crosscutter of FIG. 1 immediately before the deposition of a sheet on the stack.

After the cut has been made (FIG. 3), the web is again released by the hold-down means 10 and 11, and the conveying roll 13 is again actuated by the rolls 15 which press against the web 1. The rolls 15 then move the backed-up portion of the web 1 at increased conveying speed (for example, $1.3 \times v$), with the result that the new head end of the web 1 overlaps the tail end of the last sheet. Overlapping is promoted in that the end of the sheet is floating close to the floating bars 22. After the backed-up portion of the web has been stretched taut, there is no change in the overlapped portion, which moves over the floating bars 22. At the sheet stack, the next sheet, which is slipped between the floating bars 27 and the preceding sheet, then takes the place of the latter.

Since in proximity to the stack 23, the web 1, or rather the sheet, is transported by the floating bars 27, made of metal, no static charge that would render the stacking of the sheets difficult or even impossible can build up. The sheets drop down from the floating bars 27 and therefore float on the stack. Straightening them poses no problem, either.

What is claimed is:

1. A method of crosscutting a web and stacking the resultant sheets which comprises continuously feeding said web toward a cutter, decelerating the feed of said web at the cutting point for the duration of the cutting operation, while continuing the feed toward said cutter at the same rate whereby a back-up occurs in the feed direction, cutting said web, causing the new head end of the web so formed upon said cutting to overlap the tail end of the resultant cut sheet on the conveying path, conveying said sheet to a sheet stack, after said cut sheet is moved onward to said sheet stack at normal conveying speed increasing the conveying speed of the web toward said cutter until the web portion which has backed up ahead of the cutting point has been stretched taut and caused to overlap the tail end of the cut sheet.

2. A method according to claim 1, wherein the step of continuously feeding said web towards said cutter includes directing said web through a first conveying means upstream of said cutter, said first conveying means engaging said web, said first conveying means comprising at least two units with said backing-up occurring between said units.

3. A method according to claim 2, wherein a first of said units is provided with means to engage said web without slippage whereby to establish a basic feed rate of said web through said cutting step and a second unit is provided with means to release said second unit from engagement with said web in synchronism with actuation of said cutting step, said second unit comprising means to convey said web at a rate greater than the rate at which it is conveyed by said first unit, said second unit is provided with means to convey said web with a slippage relative to said web.

4. A method according to claim 3, wherein said cut web is conveyed toward said sheet stock by a second conveying means which is engageable with said web.

5. A method according to claim 4, wherein said first unit of said first conveying means is provided with means to convey said web at a rate substantially equal to the rate said second conveying means conveys said web.

6. A method according to claim 4, wherein said second conveying means is provided with means to convey the web with slippage relative thereto when said web is taut.

7. A method according to claim 4, wherein the distance between said point of cutting and said second conveying means is less than one sheet length.

8. A method according to claim 4, wherein said second conveying means comprises a driven conveying roll.

9. A method according to claim 8, wherein said driven conveying roll is detachably connected to a drive.

10. A method according to claim 1, wherein prior to said cutting of said web, said web is directed through and engagable by a hold-down means, said hold-down means being actuated synchronously with activation of said cutting.

11. A method according to claim 2, wherein said cutting is conducted by means of an impact cutter having two blades, each of said blades being driven by a common drive means via a transmission whereby revolution of said common drive means effects actuation of said cutting.

12. A method according to claim 11, wherein to said common drive means there is connected, via a hold-down means transmission, a hold-down means which engages said web prior to said cutting.

13. A method according to claim 11, wherein to said common drive means there is connected means to release said second unit from engagement with said web.

14. A method according to claim 13, wherein said common drive means is synchronized with the conveying speed of said first unit.

15. A method according to claim 12, wherein said impact cutter, said hold-down means and said second unit are connected to said common drive by connecting rods and said common drive comprises a crankshaft.

16. A method according to claim 1, wherein floating bars in communication with a source of blowing air are disposed above said sheet stack.

17. A method according to claim 1, wherein the resultant cut sheets are stacked on the sheet stack at a point downstream of said cutting operation.

18. A method according to claim 1, wherein said cut sheet is conveyed to said sheet stack when the conveying speed of the web is increased to the extent that the web is stretched taut.

19. A method according to claim 1, wherein the distance from the cutting point to the point at which the cut sheet is conveyed to the sheet stack is less than one sheet length.

20. A method according to claim 1, wherein the speed at which the cut sheet is conveyed to the sheet stack is varied.

21. A method according to claim 1, wherein said web is held in place while said web is cut.

* * * * *